US005697460A

United States Patent [19]

Stewart et al.

[11] Patent Number: 5,697,460

[45] Date of Patent: Dec. 16, 1997

[54] DRILL PIPE FOR DIRECTIONAL DRILLING

[76] Inventors: Arthur Deacey Stewart, Panmurs Gardens, Potterton, Aberdeen AB28 8UY; Karl Schmidt, 67 Westburn Drive, Aberdeen AB2 5BW, both of United Kingdom

[21] Appl. No.: 553,382

[22] PCT Filed: May 9, 1994

[86] PCT No.: PCT/GB94/01001

§ 371 Date: Nov. 14, 1995

§ 102(e) Date: Nov. 14, 1995

[87] PCT Pub. No.: WO94/27024

PCT Pub. Date: Nov. 24, 1994

[30] Foreign Application Priority Data

May 15, 1993 [GB] United Kingdom ..... 9310029

[51] Int. Cl.[6] ..... E21B 17/10

[52] U.S. Cl. ..... 175/325.5

[58] Field of Search ..... 175/325.1, 325.5, 175/325.6, 325.7; 166/241.6, 241.7

[56] References Cited

U.S. PATENT DOCUMENTS 3,250,578 5/1966 Lubbes .
4,385,669 5/1983 Knutsen .
4,436,158 3/1984 Carstensen .
4,674,580 6/1987 Schuh et al. .
4,811,800 3/1989 Hill et al. .
4,874,045 10/1989 Clayton .

FOREIGN PATENT DOCUMENTS 0138603 4/1985 European Pat. Off. .

*Primary Examiner*—William P. Neuder
*Attorney, Agent, or Firm*—Ratner & Prestia

[57] ABSTRACT

A drill pipe (10) having first and second end portions (12, 14) at opposite longitudinal ends thereof and a middle portion (16) extending between said first and second end portions; said end portions having a first outside diameter and said middle portion having a second outside diameter less than said first outside diameter; and said drill pipe having a plurality of centraliser means (22, 24, 26) spaced along the length of said middle portion. The centralisers have an outside diameter greater than the outside diameter of the middle portion and, preferably, equal to or greater than the outside diameter of the end portions. The centralisers may be formed integrally with the drill pipe and arc preferably arcuate in longitudinal cross section and formed with hard-faced spiral flutes.

7 Claims, 1 Drawing Sheet

DRILL PIPE FOR DIRECTIONAL DRILLING

This invention relates to rock drilling and, more particularly, to improved drill pipe for use in drill strings employed in such drilling. Most particularly, the invention relates to improved drill pipe for use in directional-hole drilling.

Lengths of drill pipe are assembled into drill strings for transmitting rotary motion from the surface to a drillbit at the bottom of the hole and to convey flushing media to the cutting face of the tool. If the drill pipe becomes stuck in-hole during drilling, then substantial time and expense is involved in remedial action such as fishing operations, side tracking wells, or, in extreme cases abandonment. The chances of sticking can be minimised by selection of appropriately sized collars and stabilizers for the bottom hole assembly. However, this does not provide a complete solution and other anti-sticking aids available to date (eg rubber stabilizers) are generally inadequate. Sticking is a particular problem in directional-hole drilling.

It is an object of the present invention to provide an improved drill pipe for incorporation in a drill string, which obviates or mitigates the problem of drill pipe becoming stuck in-hole during drilling operations.

In accordance with the invention, there is provided a drill pipe having first and second end portions at opposite longitudinal ends thereof and a middle portion extending between said first and second end portions; said end portions having a first outside diameter and said middle portion having a second outside diameter less than said first outside diameter; and said drill pipe having a plurality of centraliser means spaced along the length of said middle portion.

Preferably, each of said centraliser means comprises a region of said middle portion having an outside diameter greater than said second outside diameter.

Preferably also, the maximum outside diameter of each centraliser portion is substantially equal to or greater than said first outside diameter.

Preferably also, each of said centraliser means is formed with spiral flutes. Most preferably, said flutes provide three blades.

Preferably also, each of said centraliser means has an arcuate profile in longitudinal cross section.

Preferably also, said centraliser means are formed integrally with the drill pipe. The centraliser means may be spiral milled to form said flutes, and hard-faced.

Most preferably, there are three centraliser means spaced along said middle portion.

Normally, the end portions will include connector means for connecting the pipe in a drill string. Typically, one end portion will be formed with an internally threaded box and the other end portion with an externally threaded pin.

An embodiment of the invention will now be described with reference to the accompanying drawings, in which.

Figure 1:
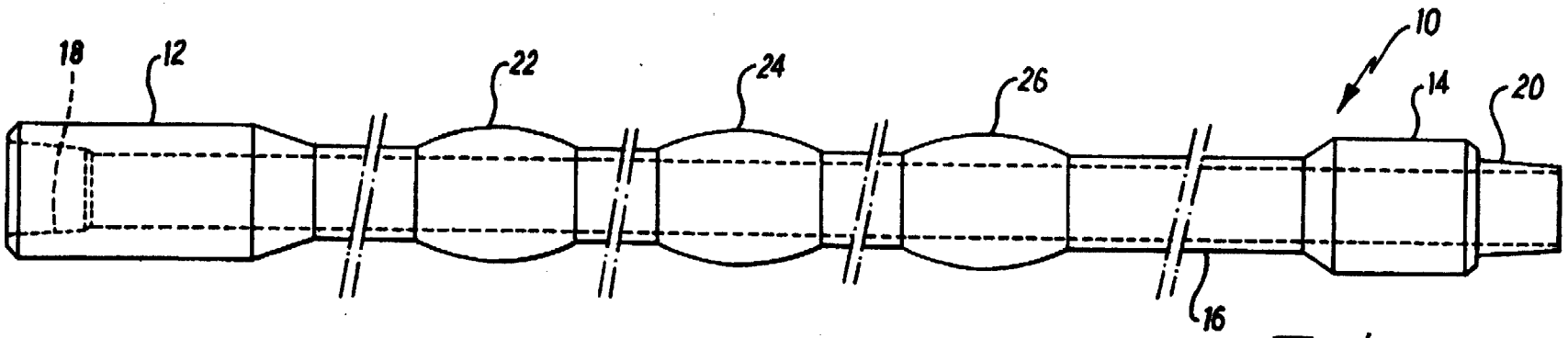
FIG. 1 is a side view of a length of drill pipe embodying the invention.

Referring now to the drawings, a length of drill pipe 10 embodying the invention comprises first and second end portions 12 and 14 at opposite longitudinal ends thereof, and a middle portion 16 interconnecting said end portions 12 and 14. The end portions 12 and 14 have a first outside diameter (OD) D1, typically in the range 4.75 to 8.5 inches (12.07 to 21.59 cm), and the middle portion 16 has an OD D2 less than D1, suitably in the range 3.5 to 6.625 inches (8.89 to 16.83 cm). The drill pipe might typically be 30 feet (9.144 m) in length, the first end 12 being formed with an internally threaded box 18 and the second end 14 being formed with an externally threaded pin 20, whereby the pipe 10 may be connected in a drill string. The pipe 10 will typically have an internal diameter in the range 2.125 to 4.25 inches (5.40 to 10.80 cm).

The drill pipe 10 is formed with a plurality, most preferably three, centraliser means 22, 24, 26, spaced along the length of the middle portion 16. In the illustrated embodiment of a 30 foot (9.144 m) pipe, the centraliser means are located, respectively, 8 feet (2.438 m) from the first end, 15 feet (4.572 m) from either end, and 8 feet (2.438 m) from the second end.

Figure 2:
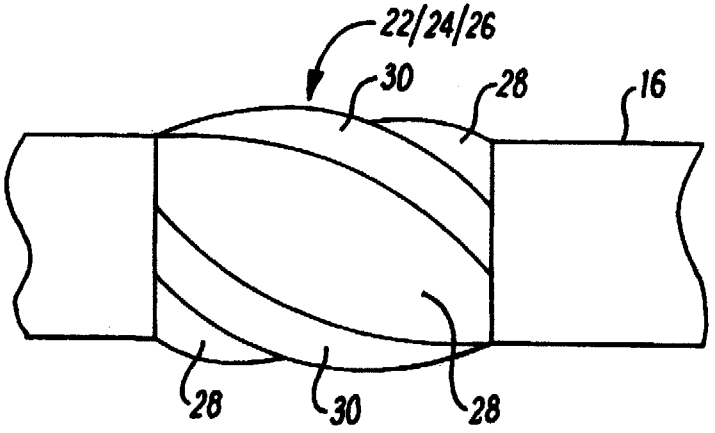
FIG. 2 is an enlarged side view of one of a plurality of centraliser means forming part of the drill pipe of FIG. 1.

Each of the centraliser means 22, 24, 26 comprises a region of increased diameter, having an arcuate profile in longitudinal cross section and having a maximum OD substantially equal to or greater than D1. In this example, the radius of curvature of the arcuate profile is suitably 7.875 inches (20 cm) or greater. As is illustrated in FIG. 2, each of the centraliser means 22, 24, 26 is formed with a plurality (suitably three) spiral flutes 28 forming a corresponding plurality of spiral blades 30.

The drill pipe 10 may be machined from hollow bar or pre-forged steel, the centralisers 22, 24, 26 being formed integrally therewith, spiral milled and hard-faced. Alternatively, the middle portion 16 of the drill pipe 10, including the centalisers 22, 24, 26, may be formed as above, the end sections 12 and 14 being formed separately and attached to the ends of the middle portion 16 by friction welding or other suitable means. This provides greater flexibility in the configuration of the pipe, allowing the the bore of the middle portion 16 to differ from that of the end sections 12, 14.

The present drill pipe may be used in drill strings along with standard drill pipe, being located in the drill string in sections where sticking is most likely to occur. In directional drilling, this will be where the angle of deviation of the hole is greatest. The configuration of the centralisers reduces the likelihood of sticking, whilst the flutes allow debris to pass.

Improvements and modifications may be incorporated without departing from the scope of the invention.

We claim:

1. A drill pipe for use in directional drilling operations having first and second end portions at opposite longitudinal ends thereof and a middle portion extending between said first and second end portions; said end portions having a first outside diameter and said middle portion having a second outside diameter less than said first outside diameter; said drill pipe having a plurality of centraliser means spaced along the length of said middle portion; and each of said centraliser means comprising a region of said middle portion having an outside diameter greater than said second said outside diameter;

characterized in that:

the maximum outside diameter of each centraliser portion is greater than said first outside diameter; and in that each of said centraliser means has an arcuate shaped body having an arcuate profile in longitudinal cross section and spiral flutes formed on the arcuate shaped body.

2. A drill pipe as claimed in claim 1, wherein said flutes provide three blades.

3. A drill pipe as claimed in claim 1 wherein said centraliser means are spiral milled to form said flutes, and hard-faced.

4. A drill pipe as claimed in claim 1 wherein said centraliser means are formed integrally with the drill pipe.

5. A drill pipe as claimed in claim 1, wherein there are three centraliser means spaced along said middle portion.

6. A drill pipe as claimed in claim 1 wherein said end portions include connector means for connecting the pipe in a drill string.

7. A drill pipe as claimed in claim 6 wherein one end portion is formed with an internally threaded box and the other end portion is formed with an externally threaded pin.

* * * * *